US009666202B2

(12) United States Patent
Gao

(10) Patent No.: US 9,666,202 B2
(45) Date of Patent: May 30, 2017

(54) ADAPTIVE BANDWIDTH EXTENSION AND APPARATUS FOR THE SAME

(71) Applicant: Huawei Technologies Co., Ltd., Shenzhen (CN)

(72) Inventor: Yang Gao, Mission Viejo, CA (US)

(73) Assignee: Huawei Technologies Co., Ltd., Shenzhen (CN)

( * ) Notice: Subject to any disclaimer, the term of this patent is extended or adjusted under 35 U.S.C. 154(b) by 152 days.

(21) Appl. No.: 14/478,839

(22) Filed: Sep. 5, 2014

(65) Prior Publication Data

US 2015/0073784 A1 Mar. 12, 2015

Related U.S. Application Data

(60) Provisional application No. 61/875,690, filed on Sep. 10, 2013.

(51) Int. Cl.
*G10L 19/12* (2013.01)
*G10L 21/038* (2013.01)
(Continued)

(52) U.S. Cl.
CPC ..... *G10L 19/12* (2013.01); *G10L 21/038* (2013.01); *G10L 19/0204* (2013.01); *G10L 19/08* (2013.01)

(58) Field of Classification Search
CPC ..... G10L 15/20; G10L 25/78; G10L 21/0208; G10L 15/02; G10L 25/87
See application file for complete search history.

(56) References Cited

U.S. PATENT DOCUMENTS 6,708,145 B1 * 3/2004 Liljeryd ..... G10L 21/038 704/200.1
7,461,003 B1 * 12/2008 Tanrikulu ..... G10L 21/038 704/500
(Continued)

FOREIGN PATENT DOCUMENTS

CN 101089951 A 12/2007
CN 101273404 A 9/2008
(Continued)

OTHER PUBLICATIONS

"Series G: Transmission Systems and Media, Digital Systems and Networks; Digital Terminal Equipments—Coding of Voice and Audio Signals," ITU-T Telecommunication Standardization Sector of ITU, G.718, Jun. 2008, 257 pages.
(Continued)

*Primary Examiner* — Fariba Sirjani
(74) *Attorney, Agent, or Firm* — Huawei Technologies Co., Ltd.

(57) ABSTRACT

In one embodiment of the present invention, a method of decoding an encoded audio bitstream and generating frequency bandwidth extension includes decoding the audio bitstream to produce a decoded low band audio signal and generate a low band excitation spectrum corresponding to a low frequency band. A sub-band area is selected from within the low frequency band using a parameter which indicates energy information of a spectral envelope of the decoded low band audio signal. A high band excitation spectrum is generated for a high frequency band by copying a sub-band excitation spectrum from the selected sub-band area to a high sub-band area corresponding to the high frequency band. Using the generated high band excitation spectrum, an extended high band audio signal is generated by applying a high band spectral envelope. The extended high band audio
(Continued)

signal is added to the decoded low band audio signal to generate an audio output signal having an extended frequency bandwidth.

20 Claims, 15 Drawing Sheets

(51) Int. Cl.
*G10L 19/08* (2013.01)
*G10L 19/02* (2013.01)

(56) References Cited

U.S. PATENT DOCUMENTS 8,296,159 B2 * 10/2012 Neuendorf ..... G10L 19/0208 704/200
8,804,970 B2 * 8/2014 Grill ..... 381/1
9,037,474 B2 * 5/2015 Gao ..... G10L 19/022 704/500
9,047,875 B2 * 6/2015 Gao ..... G10L 21/038
9,245,533 B2 * 1/2016 Liljeryd ..... G10L 21/038
2001/0044722 A1 * 11/2001 Gustafsson ..... G10L 21/038 704/258
2002/0087304 A1 * 7/2002 Kjorling ..... G10L 21/038 704/219
2002/0128839 A1 9/2002 Lindgren et al.
2004/0111257 A1 * 6/2004 Sung ..... G10L 19/173 704/219
2008/0126081 A1 * 5/2008 Geiser ..... G10L 21/038 704/201
2008/0221906 A1 * 9/2008 Nilsson ..... G10L 21/0364 704/500
2009/0157413 A1 6/2009 Oshikiri
2009/0306971 A1 * 12/2009 Kim ..... G10L 21/0364 704/203
2010/0070284 A1 * 3/2010 Oh ..... G10L 19/22 704/500
2010/0274555 A1 * 10/2010 Laaksonen ..... G10L 19/0208 704/201
2011/0173008 A1 * 7/2011 Lecomte ..... G10L 19/20 704/500
2011/0202337 A1 * 8/2011 Fuchs ..... G10L 19/20 704/231
2011/0202353 A1 * 8/2011 Neuendorf ..... G10L 19/20 704/500
2011/0202354 A1 * 8/2011 Grill ..... G10L 19/008 704/500
2011/0202355 A1 * 8/2011 Grill ..... G10L 19/18 704/500
2011/0249843 A1 * 10/2011 Holmberg ..... H04R 25/353 381/316
2011/0257979 A1 * 10/2011 Gao ..... G10L 19/26 704/500
2012/0016667 A1 1/2012 Gao
2012/0065965 A1 * 3/2012 Choo ..... G10L 21/038 704/203
2013/0096912 A1 * 4/2013 Resch ..... G10L 21/003 704/207
2013/0275142 A1 * 10/2013 Hatanaka ..... G10L 19/008 704/500
2013/0332171 A1 * 12/2013 Avendano ..... G10L 19/12 704/264
2014/0200901 A1 * 7/2014 Kawashima ..... G10L 21/0388 704/500
2014/0214413 A1 * 7/2014 Atti ..... G10L 19/26 704/219
2014/0257827 A1 * 9/2014 Norvell ..... G10L 21/038 704/500
2015/0073784 A1 * 3/2015 Gao ..... G10L 19/12 704/223
2015/0088527 A1 * 3/2015 Naslund ..... G10L 21/0388 704/500

FOREIGN PATENT DOCUMENTS

CN 102044250 A 5/2011
CN 103026408 A 4/2013
CN 103069484 A 4/2013
WO 2010003546 A2 1/2010
WO 2012012414 A1 1/2012
WO 201303257 A1 3/2013

OTHER PUBLICATIONS

"Series G" Transmission Systems and Media, Digital Systems and Networks; Digital Terminal Equipments—Coding of Analogue Signals by Methods Other than PCM, ITU-T Implementers Guide Telecommunicaiton Standardization Sector of ITU, G.723.1, Oct. 25, 2002, 6 pages.
"Series G: Transmission Systems and Media, Digital Systems and Networks; Digital Terminal Equipments—Coding of Voice and Audio Signals," ITU-T Telecommunication Standardization Sector of ITU, G.729, Jun. 2012, 151 pages.
XP8038619A. Kornagel U ED Hanker E et al, spectral widening of the excitation signal for telephone band speech enhancement. acoustic echo and noise control: a practical approach. Sep. 1, 2001. total 6 pages.
Ulrich Kornagel, "Techniques for artificial bandwidth extension of telephone speech," Signal Processing, Jun. 1, 2006, vol. 86, No. 6, pp. 1296-1306.

* cited by examiner

ADAPTIVE BANDWIDTH EXTENSION AND APPARATUS FOR THE SAME

This application claims the benefit of U.S. Provisional Application No. 61/875,690, filed on Sep. 10, 2013, entitled "Adaptive Selection of Shifting Band Based on Spectral Energy Level for Bandwidth Extension," which application is hereby incorporated herein by reference.

TECHNICAL FIELD

The present invention is generally in the field of speech processing, and in particular to adaptive band width extension and apparatus for the same.

BACKGROUND

In modern audio/speech digital signal communication system, a digital signal is compressed at encoder; the compressed information (bitstream) can be packetized and sent to decoder through a communication channel frame by frame. The system of encoder and decoder together is called codec. Speech/audio compression may be used to reduce the number of bits that represent the speech/audio signal thereby reducing the bit rate needed for transmission. Speech/audio compression technology can be generally classified into time domain coding and frequency domain coding. Time domain coding is usually used for coding speech signal or for coding audio signal at low bit rates. Frequency domain coding is usually used for coding audio signal or for coding speech signal at high bit rates. Bandwidth Extension (BWE) can be a part of time domain coding or frequency domain coding in order to generate a high band signal at very low bit rate or at zero bit rate.

However, speech coders are lossy coders, i.e., the decoded signal is different from the original. Therefore, one of the goals in speech coding is to minimize the distortion (or perceptible loss) at a given bit rate, or minimize the bit rate to reach a given distortion.

Speech coding differs from other forms of audio coding in that speech is a much simpler signal than most other audio signals, and a lot more statistical information is available about the properties of speech. As a result, some auditory information which is relevant in audio coding can be unnecessary in the speech coding context. In speech coding, the most important criterion is preservation of intelligibility and "pleasantness" of speech, with a constrained amount of transmitted data.

The intelligibility of speech includes, besides the actual literal content, also speaker identity, emotions, intonation, timbre etc. that are all important for perfect intelligibility. The more abstract concept of pleasantness of degraded speech is a different property than intelligibility, since it is possible that degraded speech is completely intelligible, but subjectively annoying to the listener.

The redundancy of speech wave forms may be considered with respect to several different types of speech signal, such as voiced and unvoiced speech signals. Voiced sounds, e.g., 'a', 'b', are essentially due to vibrations of the vocal cords, and are oscillatory. Therefore, over short periods of time, they are well modeled by sums of periodic signals such as sinusoids. In other words, for voiced speech, the speech signal is essentially periodic. However, this periodicity may be variable over the duration of a speech segment and the shape of the periodic wave usually changes gradually from segment to segment. A low bit rate speech coding could greatly benefit from exploring such periodicity. The voiced speech period is also called pitch, and pitch prediction is often named Long-Term Prediction (LTP). In contrast, unvoiced sounds such as 's', 'sh', are more noise-like. This is because unvoiced speech signal is more like a random noise and has a smaller amount of predictability.

Traditionally, all parametric speech coding methods such as time domain coding make use of the redundancy inherent in the speech signal to reduce the amount of information that must be sent and to estimate the parameters of speech samples of a signal at short intervals. This redundancy primarily arises from the repetition of speech wave shapes at a quasi-periodic rate, and the slow changing spectral envelop of speech signal.

The redundancy of speech wave forms may be considered with respect to several different types of speech signal, such as voiced and unvoiced. Although the speech signal is essentially periodic for voiced speech, this periodicity may be variable over the duration of a speech segment and the shape of the periodic wave usually changes gradually from segment to segment. A low bit rate speech coding could greatly benefit from exploring such periodicity. The voiced speech period is also called pitch, and pitch prediction is often named Long-Term Prediction (LTP). As for unvoiced speech, the signal is more like a random noise and has a smaller amount of predictability.

In either case, parametric coding may be used to reduce the redundancy of the speech segments by separating the excitation component of speech signal from the spectral envelop component. The slowly changing spectral envelope can be represented by Linear Prediction Coding (LPC) also called Short-Term Prediction (STP). A low bit rate speech coding could also benefit a lot from exploring such a Short-Term Prediction. The coding advantage arises from the slow rate at which the parameters change. Yet, it is rare for the parameters to be significantly different from the values held within a few milliseconds. Accordingly, at the sampling rate of 8 kHz, 12.8 kHz or 16 kHz, the speech coding algorithm is such that the nominal frame duration is in the range of ten to thirty milliseconds. A frame duration of twenty milliseconds is the most common choice.

Audio coding based on filter bank technology is widely used, e.g., in frequency domain coding. In signal processing, a filter bank is an array of band-pass filters that separates the input signal into multiple components, each one carrying a single frequency subband of the original signal. The process of decomposition performed by the filter bank is called analysis, and the output of filter bank analysis is referred to as a subband signal with as many subbands as there are filters in the filter bank. The reconstruction process is called filter bank synthesis. In digital signal processing, the term filter bank is also commonly applied to a bank of receivers. The difference is that receivers also down-convert the subbands to a low center frequency that can be re-sampled at a reduced rate. The same result can sometimes be achieved by undersampling the bandpass subbands. The output of filter bank analysis could be in a form of complex coefficients. Each complex coefficient contains real element and imaginary element respectively representing cosine term and sine term for each subband of filter bank.

In more recent well-known standards such as G.723.1, G.729, G.718, Enhanced Full Rate (EFR), Selectable Mode Vocoder (SMV), Adaptive Multi-Rate (AMR), Variable-Rate Multimode Wideband (VMR-WB), or Adaptive Multi-Rate Wideband (AMR-WB), Code Excited Linear Prediction Technique ("CELP") has been adopted. CELP is commonly understood as a technical combination of Coded Excitation, Long-Term Prediction and Short-Term Prediction. CELP is mainly used to encode speech signal by benefiting from specific human voice characteristics or human vocal voice production model. CELP Speech Coding is a very popular algorithm principle in speech compression area although the details of CELP for different codecs could be significantly different. Owing to its popularity, CELP algorithm has been used in various ITU-T, MPEG, 3GPP, and 3GPP2 standards. Variants of CELP include algebraic CELP, relaxed CELP, low-delay CELP and vector sum excited linear prediction, and others. CELP is a generic term for a class of algorithms and not for a particular codec.

The CELP algorithm is based on four main ideas. First, a source-filter model of speech production through linear prediction (LP) is used. The source-filter model of speech production models speech as a combination of a sound source, such as the vocal cords, and a linear acoustic filter, the vocal tract (and radiation characteristic). In implementation of the source-filter model of speech production, the sound source, or excitation signal, is often modelled as a periodic impulse train, for voiced speech, or white noise for unvoiced speech. Second, an adaptive and a fixed codebook is used as the input (excitation) of the LP model. Third, a search is performed in closed-loop in a "perceptually weighted domain." Fourth, vector quantization (VQ) is applied.

SUMMARY

An embodiment of the present invention describes a method of decoding an encoded audio bitstream and generating frequency bandwidth extension at a decoder. The method comprises decoding the audio bitstream to produce a decoded low band audio signal and generate a low band excitation spectrum corresponding to a low frequency band. A sub-band area is selected from within the low frequency band using a parameter which indicates energy information of a spectral envelope of the decoded low band audio signal. A high band excitation spectrum is generated for a high frequency band by copying a sub-band excitation spectrum from the selected sub-band area to a high sub-band area corresponding to the high frequency band. Using the generated high band excitation spectrum, an extended high band audio signal is generated by applying a high band spectral envelope. The extended high band audio signal is added to the decoded low band audio signal to generate an audio output signal having an extended frequency bandwidth.

In accordance with an alternative embodiment of the present invention, a decoder for decoding an encoded audio bitstream and generating frequency bandwidth comprises a low band decoding unit configured to decode the audio bitstream to produce a decoded low band audio signal and to generate a low band excitation spectrum corresponding to a low frequency band. The decoder further includes a band width extension unit coupled to the low band decoding unit. The band width extension unit comprises a sub band selection unit and a copying unit. The sub band selection unit is configured to select a sub-band area from within the low frequency band using a parameter which indicates energy information of a spectral envelope of the decoded low band audio signal. The copying unit is configured to generate a high band excitation spectrum for a high frequency band by copying a sub-band excitation spectrum from the selected sub-band area to a high sub-band area corresponding to the high frequency band.

In accordance with an alternative embodiment of the present invention, a decoder for speech processing comprises a processor and a computer readable storage medium storing programming for execution by the processor. The programming includes instructions to decode the audio bitstream to produce a decoded low band audio signal and generate a low band excitation spectrum corresponding to a low frequency band. The programming include instructions to select a sub-band area from within the low frequency band using a parameter which indicates energy information of a spectral envelope of the decoded low band audio signal, and generate a high band excitation spectrum for a high frequency band by copying a sub-band excitation spectrum from the selected sub-band area to a high sub-band area corresponding to the high frequency band. The programming further include instructions to use the generated high band excitation spectrum to generate an extended high band audio signal by applying an high band spectral envelope, and add the extended high band audio signal to the decoded low band audio signal to generate an audio output signal having an extended frequency bandwidth.

An alternative embodiment of the present invention describes a method of decoding an encoded audio bitstream and generating frequency bandwidth extension at a decoder. The method comprises decoding the audio bitstream to produce a decoded low band audio signal and generate a low band spectrum corresponding to a low frequency band and selecting a sub-band area from within the low frequency band using a parameter which indicates energy information of a spectral envelope of the decoded low band audio signal. The method further includes generating a high band spectrum by copying a sub-band spectrum from the selected sub-band area to a high sub-band area, and using the generated high band spectrum to generate an extended high band audio signal by applying a high band spectral envelope energy. The method further includes adding the extended high band audio signal to the decoded low band audio signal to generate an audio output signal having an extended frequency bandwidth.

BRIEF DESCRIPTION OF THE DRAWINGS

For a more complete understanding of the present invention, and the advantages thereof, reference is now made to the following descriptions taken in conjunction with the accompanying drawings, in which:

FIGS. 5A and 5B illustrate an example of encoding/decoding with Band Width Extension (BWE), wherein FIG. 5A illustrates operations at the encoder with BWE side information while FIG. 5B illustrates operations at the decoder with BWE;

FIGS. 6A and 6B illustrate another example of encoding/decoding with an BWE without transmitting side information, wherein FIG. 6A illustrates operations during at an encoder while FIG. 6B illustrates operations at a decoder;

DETAILED DESCRIPTION OF ILLUSTRATIVE EMBODIMENTS

In modern audio/speech digital signal communication system, a digital signal is compressed at an encoder, and the compressed information or bit-stream can be packetized and sent to a decoder frame by frame through a communication channel. The decoder receives and decodes the compressed information to obtain the audio/speech digital signal.

The present invention generally relates to speech/audio signal coding and speech/audio signal bandwidth extension. In particular, embodiments of the present invention may be used to improve the standard of ITU-T AMR-WB speech coder in the field of bandwidth extension.

Some frequencies are more important than others. The important frequencies can be coded with a fine resolution. Small differences at these frequencies are significant and a coding scheme that preserves these differences is needed. On the other hand, less important frequencies do not have to be exact. A coarser coding scheme can be used, even though some of the finer details will be lost in the coding. Typical coarser coding scheme is based on a concept of Band Width Extension (BWE). This technology concept is also called High Band Extension (HBE), SubBand Replica (SBR) or Spectral Band Replication (SBR). Although the name could be different, they all have the similar meaning of encoding/decoding some frequency sub-bands (usually high bands) with little budget of bit rate (even zero budget of bit rate) or significantly lower bit rate than normal encoding/decoding approach.

In SBR technology, the spectral fine structure in high frequency band is copied from low frequency band and some random noise may be added. Then, the spectral envelope in high frequency band is shaped by using side information transmitted from encoder to decoder. Frequency band shifting or copying from low band to high band is normally the first step for BWE technology.

Embodiments of the present invention will be described for improving BWE technology by using an adaptive process to select shifting band based on energy level of the spectral envelope.

Figure 1:
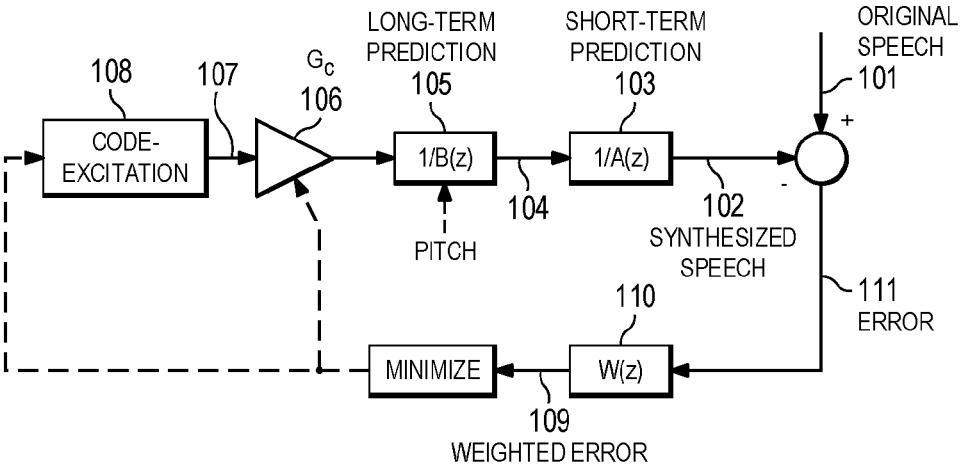
Figure 1 (Prior Art)
FIG. 1 illustrates operations performed during encoding of an original speech using a conventional CELP encoder.

FIG. 1 illustrates operations performed during encoding of an original speech using a conventional CELP encoder.

FIG. 1 illustrates a conventional initial CELP encoder where a weighted error 109 between a synthesized speech 102 and an original speech 101 is minimized often by using an analysis-by-synthesis approach, which means that the encoding (analysis) is performed by perceptually optimizing the decoded (synthesis) signal in a closed loop.

The basic principle that all speech coders exploit is the fact that speech signals are highly correlated waveforms. As an illustration, speech can be represented using an autoregressive (AR) model as in Equation (11) below.

$$X_n = \sum_{i=1}^{L} a_i X_{n-1} + e_n \tag{11}$$

In Equation (11), each sample is represented as a linear combination of the previous L samples plus a white noise. The weighting coefficients $a_1, a_2, \ldots a_L$, are called Linear Prediction Coefficients (LPCs). For each frame, the weighting coefficients $a_1, a_2, \ldots a_L$, are chosen so that the spectrum of $\{X_1, X_2, \ldots, X_N\}$, generated using the above model, closely matches the spectrum of the input speech frame.

Alternatively, speech signals may also be represented by a combination of a harmonic model and noise model. The harmonic part of the model is effectively a Fourier series representation of the periodic component of the signal. In general, for voiced signals, the harmonic plus noise model of speech is composed of a mixture of both harmonics and noise. The proportion of harmonic and noise in a voiced speech depends on a number of factors including the speaker characteristics (e.g., to what extent a speaker's voice is normal or breathy); the speech segment character (e.g. to what extent a speech segment is periodic) and on the frequency. The higher frequencies of voiced speech have a higher proportion of noise-like components.

Linear prediction model and harmonic noise model are the two main methods for modelling and coding of speech signals. Linear prediction model is particularly good at modelling the spectral envelop of speech whereas harmonic noise model is good at modelling the fine structure of speech. The two methods may be combined to take advantage of their relative strengths.

As indicated previously, before CELP coding, the input signal to the handset's microphone is filtered and sampled, for example, at a rate of 8000 samples per second. Each sample is then quantized, for example, with 13 bit per sample. The sampled speech is segmented into segments or frames of 20 ms (e.g., in this case 160 samples).

The speech signal is analyzed and its LP model, excitation signals and pitch are extracted. The LP model represents the spectral envelop of speech. It is converted to a set of line spectral frequencies (LSF) coefficients, which is an alternative representation of linear prediction parameters, because LSF coefficients have good quantization properties. The LSF coefficients can be scalar quantized or more efficiently they can be vector quantized using previously trained LSF vector codebooks.

The code-excitation includes a codebook comprising codevectors, which have components that are all independently chosen so that each codevector may have an approximately 'white' spectrum. For each subframe of input speech, each of the codevectors is filtered through the short-term linear prediction filter 103 and the long-term prediction filter 105, and the output is compared to the speech samples. At each subframe, the codevector whose output best matches the input speech (minimized error) is chosen to represent that subframe.

The coded excitation 108 normally comprises pulse-like signal or noise-like signal, which are mathematically constructed or saved in a codebook. The codebook is available to both the encoder and the receiving decoder. The coded excitation 108, which may be a stochastic or fixed codebook, may be a vector quantization dictionary that is (implicitly or explicitly) hard-coded into the codec. Such a fixed codebook may be an algebraic code-excited linear prediction or be stored explicitly.

A codevector from the codebook is scaled by an appropriate gain to make the energy equal to the energy of the input speech. Accordingly, the output of the coded excitation 108 is scaled by a gain $G_c$ 107 before going through the linear filters.

The short-term linear prediction filter 103 shapes the 'white' spectrum of the codevector to resemble the spectrum of the input speech. Equivalently, in time-domain, the short-term linear prediction filter 103 incorporates short-term correlations (correlation with previous samples) in the white sequence. The filter that shapes the excitation has an all-pole model of the form 1/A(z) (short-term linear prediction filter 103), where A(z) is called the prediction filter and may be obtained using linear prediction (e.g., Levinson-Durbin algorithm). In one or more embodiments, an all-pole filter may be used because it is a good representation of the human vocal tract and because it is easy to compute.

The short-term linear prediction filter 103 is obtained by analyzing the original signal 101 and represented by a set of coefficients:

$$A(z) = \sum_{i=1}^{P} 1 + a_i \cdot z^{-i},\ i = 1, 2, \ldots, P \tag{12}$$

As previously described, regions of voiced speech exhibit long term periodicity. This period, known as pitch, is introduced into the synthesized spectrum by the pitch filter 1/(B(z)). The output of the long-term prediction filter 105 depends on pitch and pitch gain. In one or more embodiments, the pitch may be estimated from the original signal, residual signal, or weighted original signal. In one embodiment, the long-term prediction function (B(z)) may be expressed using Equation (13) as follows.

$$B(z)=1-G_p \cdot z^{-Pitch} \tag{13}$$

The weighting filter 110 is related to the above short-term prediction filter. One of the typical weighting filters may be represented as described in Equation (14).

$$W(z) = \frac{A(z/\alpha)}{1-\beta \cdot z^{-1}} \tag{14}$$

where $\beta<\alpha$, $0<\beta<1$, $0<\alpha\leq 1$.

In another embodiment, the weighting filter W(z) may be derived from the LPC filter by the use of bandwidth expansion as illustrated in one embodiment in Equation (15) below.

$$W(z) = \frac{A(z/\gamma 1)}{A(z/\gamma 2)}, \tag{15}$$

In Equation (15), $\gamma 1>\gamma 2$, which are the factors with which the poles are moved towards the origin.

Accordingly, for every frame of speech, the LPCs and pitch are computed and the filters are updated. For every subframe of speech, the codevector that produces the 'best' filtered output is chosen to represent the subframe. The corresponding quantized value of gain has to be transmitted to the decoder for proper decoding. The LPCs and the pitch values also have to be quantized and sent every frame for reconstructing the filters at the decoder. Accordingly, the coded excitation index, quantized gain index, quantized long-term prediction parameter index, and quantized short-term prediction parameter index are transmitted to the decoder.

Figure 2:
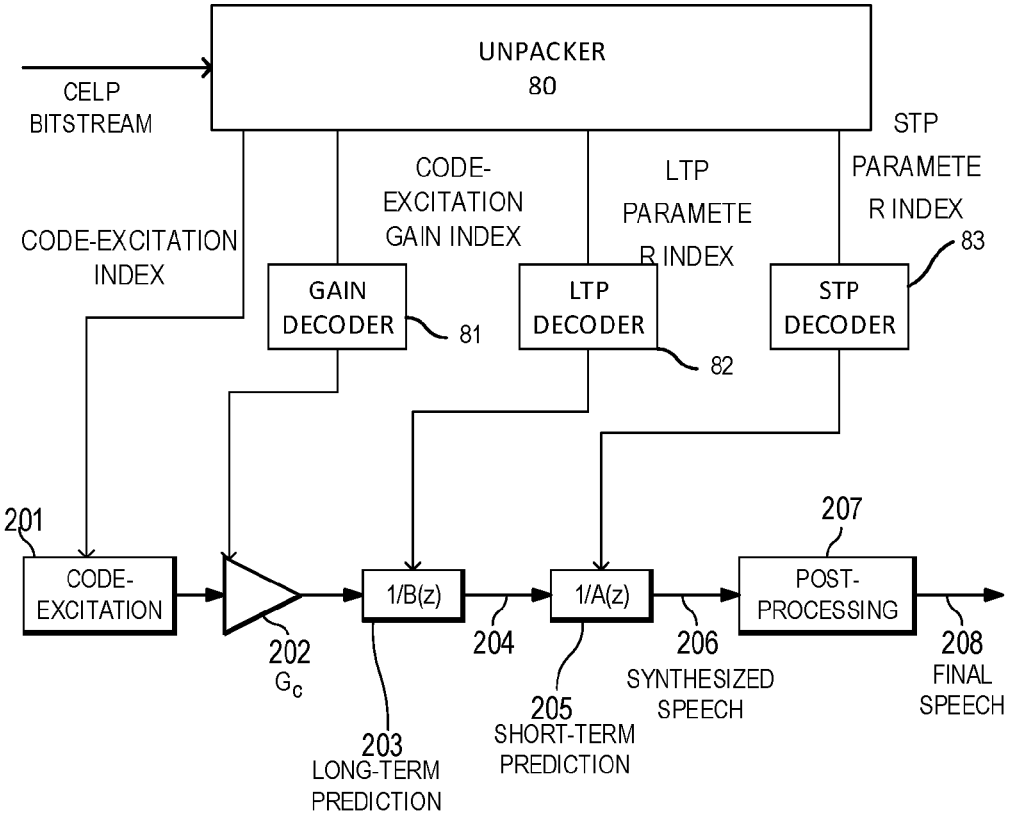
FIG. 2 illustrates operations performed during decoding of an original speech using a CELP decoder in implementing embodiments of the present invention as will be described further below.

FIG. 2 illustrates operations performed during decoding of an original speech using a CELP decoder in implementing embodiments of the present invention as will be described below.

The speech signal is reconstructed at the decoder by passing the received codevectors through the corresponding filters. Consequently, every block except post-processing has the same definition as described in the encoder of FIG. 1.

The coded CELP bitstream is received and unpacked 80 at a receiving device. For each subframe received, the received coded excitation index, quantized gain index, quantized long-term prediction parameter index, and quantized short-term prediction parameter index, are used to find the corresponding parameters using corresponding decoders, for example, gain decoder 81, long-term prediction decoder 82, and short-term prediction decoder 83. For example, the positions and amplitude signs of the excitation pulses and the algebraic code vector of the code-excitation 402 may be determined from the received coded excitation index.

Referring to FIG. 2, the decoder is a combination of several blocks which includes coded excitation 201, long-term prediction 203, short-term prediction 205. The initial decoder further includes post-processing block 207 after a synthesized speech 206. The post-processing may further comprise short-term post-processing and long-term post-processing.

Figure 3:
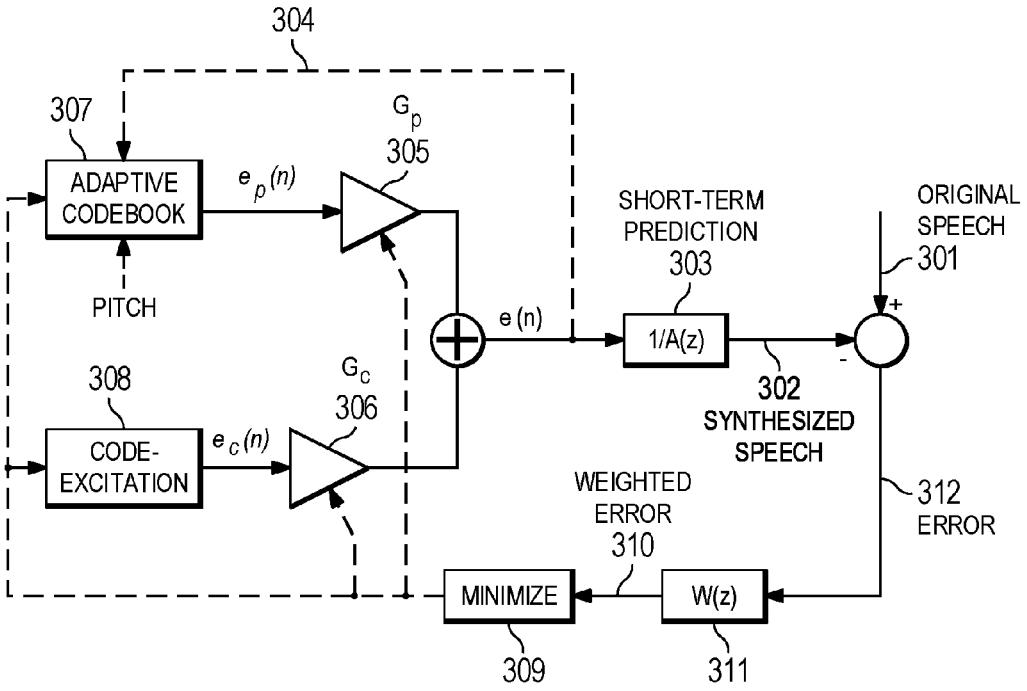
Figure 3 (Prior Art)
FIG. 3 illustrates operations performed during encoding of an original speech in a conventional CELP encoder.

FIG. 3 illustrates a conventional CELP encoder.

FIG. 3 illustrates a basic CELP encoder using an additional adaptive codebook for improving long-term linear prediction. The excitation is produced by summing the contributions from an adaptive codebook 307 and a code excitation 308, which may be a stochastic or fixed codebook as described previously. The entries in the adaptive codebook comprise delayed versions of the excitation. This makes it possible to efficiently code periodic signals such as voiced sounds.

Referring to FIG. 3, an adaptive codebook 307 comprises a past synthesized excitation 304 or repeating past excitation pitch cycle at pitch period. Pitch lag may be encoded in integer value when it is large or long. Pitch lag is often encoded in more precise fractional value when it is small or short. The periodic information of pitch is employed to generate the adaptive component of the excitation. This excitation component is then scaled by a gain $G_p$ 305 (also called pitch gain).

Long-Term Prediction plays a very important role for voiced speech coding because voiced speech has strong periodicity. The adjacent pitch cycles of voiced speech are similar to each other, which means mathematically the pitch gain $G_p$ in the following excitation express is high or close to 1. The resulting excitation may be expressed as in Equation (16) as combination of the individual excitations.

$$e(n)=G_p \cdot e_p(n)+G_c \cdot e_c(n) \quad (16)$$

where, $e_p(n)$ is one subframe of sample series indexed by n, coming from the adaptive codebook 307 which comprises the past excitation 304 through the feedback loop (FIG. 3). $e_p(n)$ may be adaptively low-pass filtered as the low frequency area is often more periodic or more harmonic than high frequency area. $e_c(n)$ is from the coded excitation codebook 308 (also called fixed codebook) which is a current excitation contribution. Further, $e_c(n)$ may also be enhanced such as by using high pass filtering enhancement, pitch enhancement, dispersion enhancement, formant enhancement, and others.

For voiced speech, the contribution of $e_p(n)$ from the adaptive codebook 307 may be dominant and the pitch gain $G_p$ 305 is around a value of 1. The excitation is usually updated for each subframe. Typical frame size is 20 milliseconds and typical subframe size is 5 milliseconds.

As described in FIG. 1, the fixed coded excitation 308 is scaled by a gain $G_c$ 306 before going through the linear filters. The two scaled excitation components from the fixed coded excitation 108 and the adaptive codebook 307 are added together before filtering through the short-term linear prediction filter 303. The two gains ($G_p$ and $G_c$) are quantized and transmitted to a decoder. Accordingly, the coded excitation index, adaptive codebook index, quantized gain indices, and quantized short-term prediction parameter index are transmitted to the receiving audio device.

Figure 4:
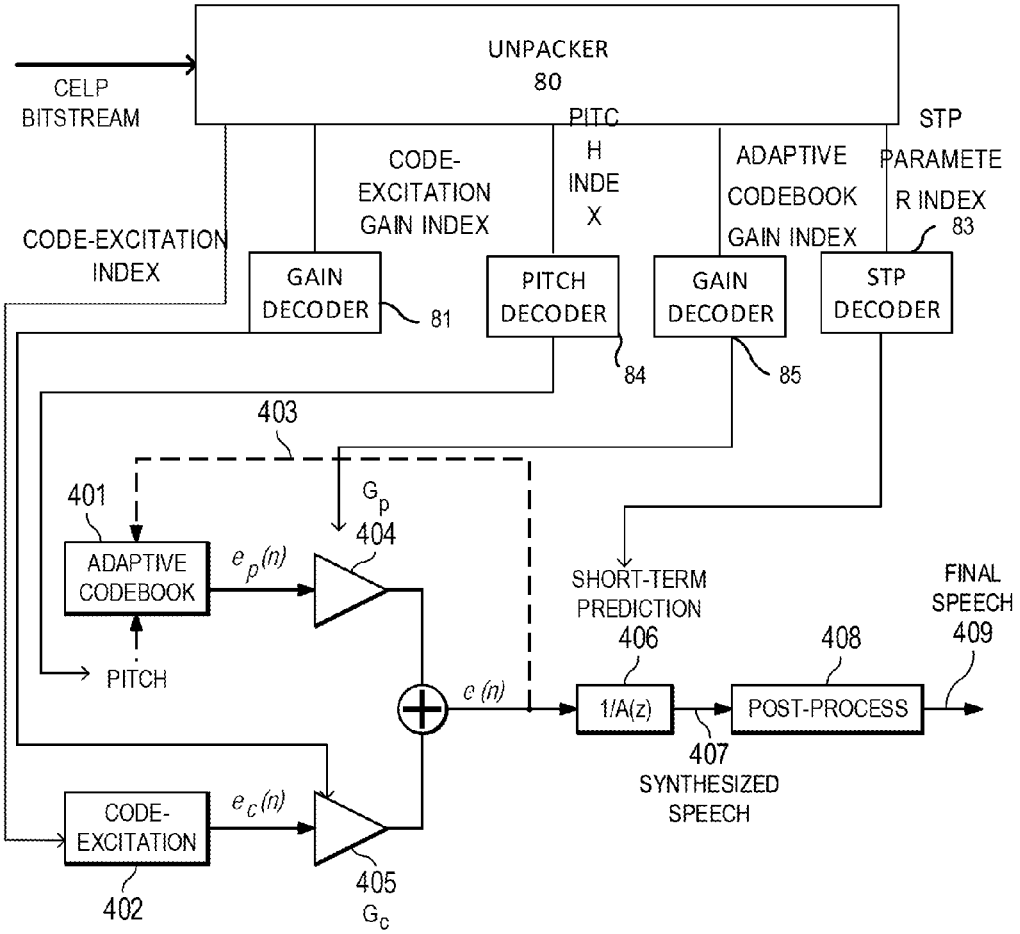
FIG. 4 illustrates a basic CELP decoder corresponding to the encoder in FIG. 5 in implementing embodiments of the present invention as will be described below.

The CELP bitstream coded using a device illustrated in FIG. 3 is received at a receiving device. FIG. 4 illustrate the corresponding decoder of the receiving device.

FIG. 4 illustrates a basic CELP decoder corresponding to the encoder in FIG. 5. FIG. 4 includes a post-processing block 408 receiving the synthesized speech 407 from the main decoder. This decoder is similar to FIG. 3 except the adaptive codebook 307.

For each subframe received, the received coded excitation index, quantized coded excitation gain index, quantized pitch index, quantized adaptive codebook gain index, and quantized short-term prediction parameter index, are used to find the corresponding parameters using corresponding decoders, for example, gain decoder 81, pitch decoder 84, adaptive codebook gain decoder 85, and short-term prediction decoder 83.

In various embodiments, the CELP decoder is a combination of several blocks and comprises coded excitation 402, adaptive codebook 401, short-term prediction 406, and post-processing 408. Every block except post-processing has the same definition as described in the encoder of FIG. 3. The post-processing may further include short-term post-processing and long-term post-processing.

As already mentioned, CELP is mainly used to encode speech signal by benefiting from specific human voice characteristics or human vocal voice production model. In order to encode speech signal more efficiently, speech signal may be classified into different classes and each class is encoded in a different way. Voiced/Unvoiced classification or Unvoiced Decision may be an important and basic classification among all the classifications of different classes. For each class, LPC or STP filter is always used to represent the spectral envelope. But the excitation to the LPC filter may be different. Unvoiced signals may be coded with a noise-like excitation. On the other hand, voiced signals may be coded with a pulse-like excitation.

The code-excitation block (referenced with label 308 in FIGS. 3 and 402 in FIG. 4) illustrates the location of Fixed Codebook (FCB) for a general CELP coding. A selected code vector from FCB is scaled by a gain often noted as $G_c$ 306.

Figure 5A:
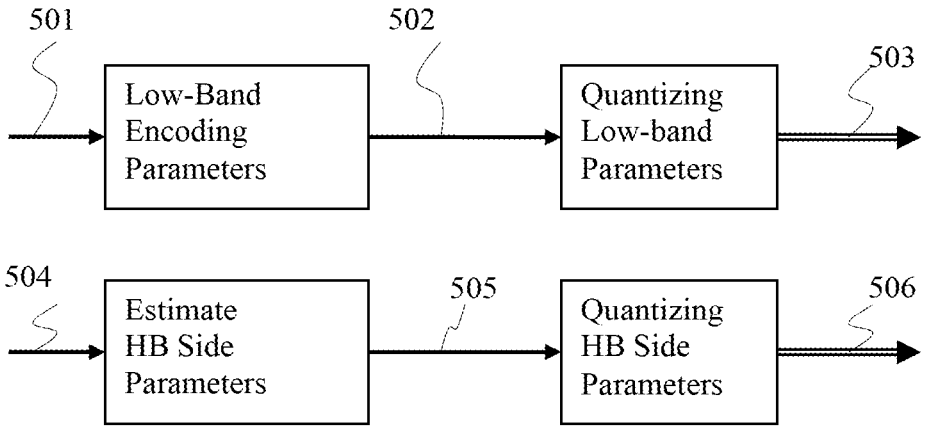
Figure 5B:
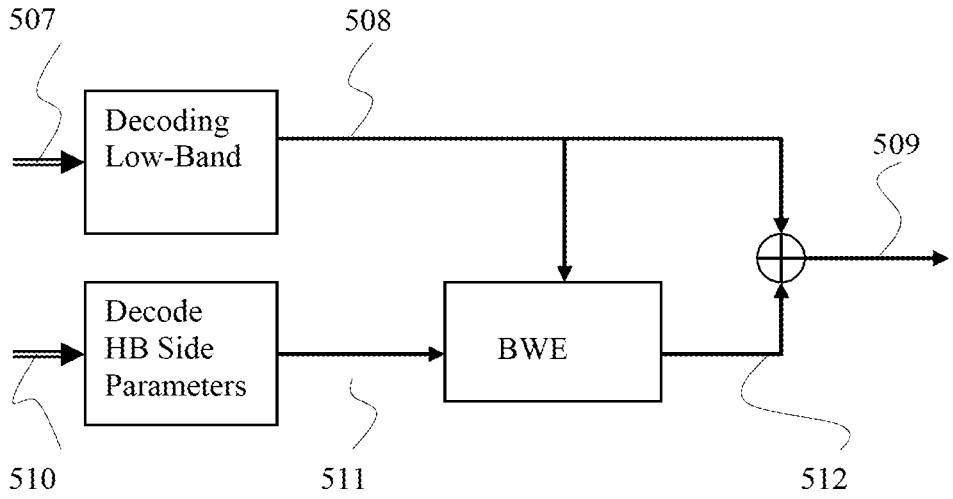

FIGS. 5A and 5B illustrate an example of encoding/decoding with Band Width Extension (BWE). FIG. 5A illustrates operations at the encoder with BWE side information while FIG. 5B illustrates operations at the decoder with BWE.

Low band signal 501 is encoded by using low band parameters 502. The low band parameters 502 are quantized and the generated quantization index may be transmitted through a bitstream channel 503. The high band signal extracted from audio/speech signal 504 is encoded with small amount of bits by using the high band side parameters 505. The quantized high band side parameters (side information index) are transmitted through the bitstream channel 506.

Referring to FIG. 5B, at the decoder, the low band bitstream 507 is used to produce a decoded low band signal 508. The high band side bitstream 510 is used to decode the high band side parameters 511. The high band signal 512 is generated from the low band signal 508 with help from the high band side parameters 511. The final audio/speech signal 509 is produced by combining the low band signal 508 and the high band signal 512.

Figure 6A:
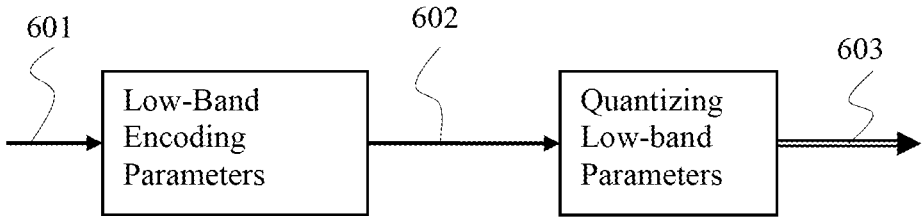
Figure 6B:
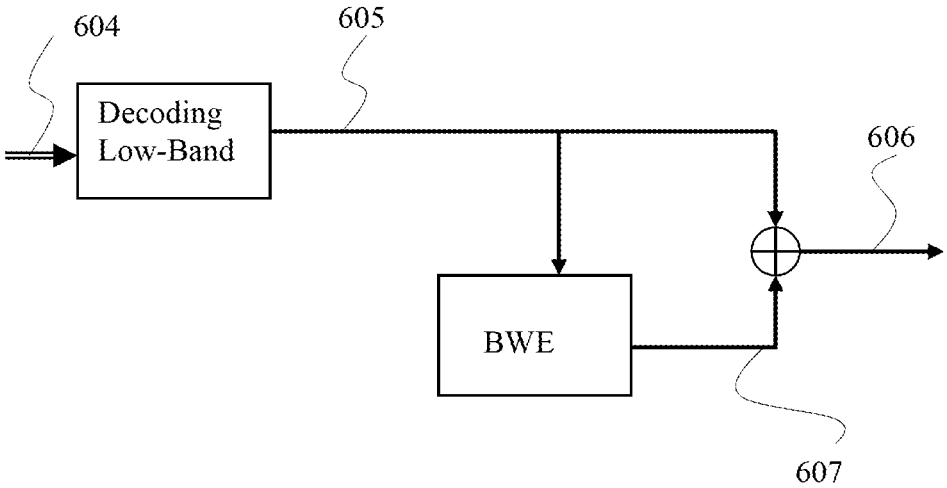

FIGS. 6A and 6B illustrate another example of encoding/decoding with an BWE without transmitting side information. FIG. 6A illustrates operations during at an encoder while FIG. 6B illustrates operations at a decoder.

Referring to FIG. 6A, low band signal 601 is encoded by using low band parameters 602. The low band parameters 602 are quantized to generate a quantization index, which may be transmitted through the bitstream channel 603.

Referring to FIG. 6B, at the decoder, the low band bitstream 604 is used to produce a decoded low band signal 605. The high band signal 607 is generated from the low band signal 605 without help from transmitting side information. The final audio/speech signal 606 is produced by combining the low band signal 605 and the high band signal 607.

Figure 7:
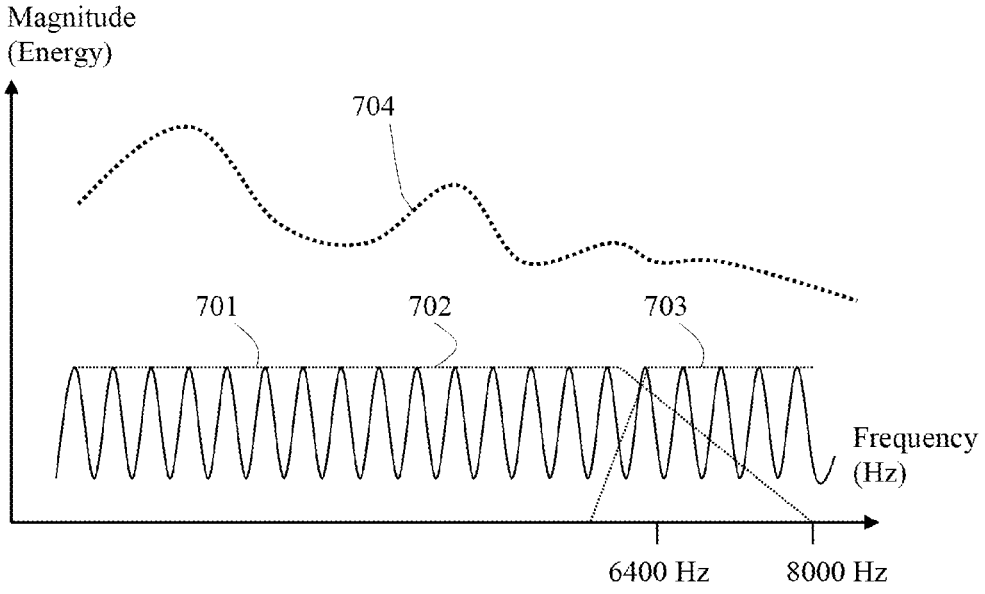
FIG. 7 illustrates an example of an ideal excitation spectrum for voiced speech or harmonic music when the CELP type of codec is used.

FIG. 7 illustrates an example of an ideal excitation spectrum for voiced speech or harmonic music when the CELP type of codec is used.

The ideal excitation spectrum 702 is almost flat after removing LPC spectral envelope 704. The ideal low band excitation spectrum 701 may be used as a reference for the low band excitation encoding. The ideal high band excitation spectrum 703 is not available at the decoder. Theoretically, the ideal or unquantized high band excitation spectrum could have almost the same energy level as the low band excitation spectrum.

In practice, the synthesized or decoded excitation spectrum does not look so good as the ideal excitation spectrum shown in FIG. 7.

Figure 8:
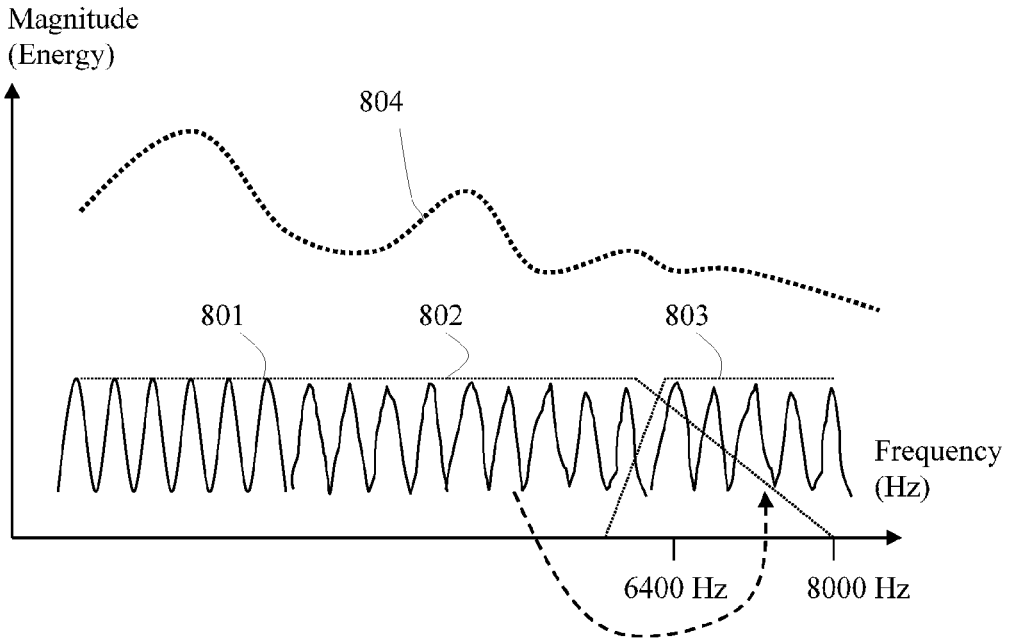
Figure 8 (Prior Art)
FIG. 8 shows an example of a conventional bandwidth extension of a decoded excitation spectrum for voiced speech or harmonic music when the CELP type of codec is used.

FIG. 8 shows an example of a decoded excitation spectrum for voiced speech or harmonic music when the CELP type of codec is used.

The decoded excitation spectrum 802 is almost flat after removing the LPC spectral envelope 804. The decoded low band excitation spectrum 801 is available at the decoder. The quality of the decoded low band excitation spectrum 801 becomes worse or more distorted especially in the region where the envelope energy is low. This is caused due to reasons. For example, the two major reasons are that the closed-loop CELP coding emphasizes more on high energy area than low energy area, and that the waveform matching for low frequency signal is easier than high frequency signal due to faster changing of the high frequency signal. For low bit rate CELP coding such as AMR-WB, the high band is usually not encoded but generated in the decoder with BWE technology. In this case, the high band excitation spectrum 803 may be simply copied from the low band excitation spectrum 801 and the high band spectral energy envelope may be predicted or estimated from the low band spectral energy envelope. Following a traditional way, the generated high band excitation spectrum 803 after 6400 Hz is copied from the subband just before 6400 Hz. This may be good if the spectrum quality is equivalent from 0 Hz to 6400 Hz. However, for a low bit rate CELP codec, the spectrum quality may vary a lot from 0 Hz to 6400 Hz. The copied subband from the end area of the low frequency band just before 6400 Hz may be of a poor quality, which then introduces extra noisy sound into the high band area from 6400 Hz to 8000 Hz.

The bandwidth of the extended high frequency band is usually much smaller than that of the coded low frequency band. Therefore, in various embodiments, a best sub band from the low band is selected and copied into the high band area.

The high quality sub band possibly exists at any location within the whole low frequency band. The most possible location of the high quality sub band is within the region corresponding to the high spectral energy area—the spectral formant area.

Figure 9:
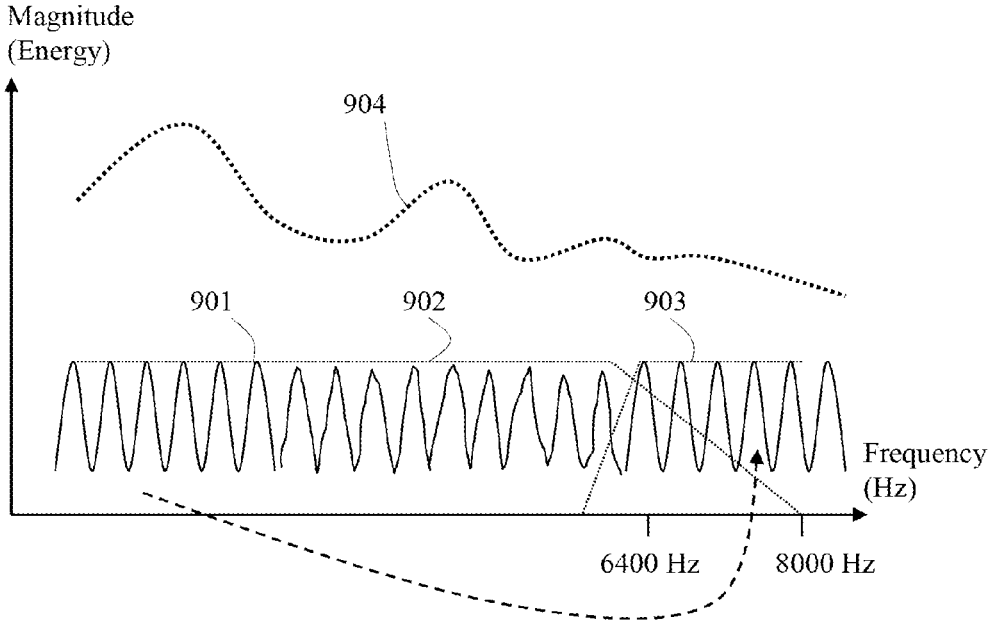
FIG. 9 illustrates an example of an embodiment of the present invention of band width extension applied to the decoded excitation spectrum for voiced speech or harmonic music when the CELP type of codec is used.

FIG. 9 illustrates an example of the decoded excitation spectrum for voiced speech or harmonic music when the CELP type of codec is used.

The decoded excitation spectrum 902 is almost flat after removing the LPC spectral envelope 904. The decoded low band excitation spectrum 901 is available at the decoder but is unavailable at the high band 903. The quality of the decoded low band excitation spectrum 901 becomes worse or more distorted especially in the region where the energy of the spectral envelope 904 is lower.

In the illustrated case of FIG. 9, in one embodiment, the high quality sub band is located around the first speech formant area (e.g., around 2000 Hz in this example embodiment). In various embodiments, the high quality sub band may be located at any location between 0 and 6400 Hz.

After determining the location of the best sub band, it is copied from within the low band into the high band, as further illustrated in FIG. 9. The high band excitation spectrum 903 is thus generated by copying from the selected sub band. The perceptual quality of the high band 903 in FIG. 9 sounds much better than the high band 803 in FIG. 8 because of the improved excitation spectrum.

In one or more embodiments, if the low band spectrum envelope is available in frequency domain at the decoder, the best sub band may be determined by searching for the highest sub band energy from all the sub bands candidates.

Alternatively, in one or more embodiments, if the frequency domain spectrum envelope is not available, the high energy location may also be determined from any parameters which can reflect spectral energy envelope or spectral formant peak. The best sub band location for BWE corresponds to the highest spectral peak location.

The searching range of the best sub band starting point may depend on the codec bit rate. For example, for a very low bit rate codec, the searching range can be from 0 to 6400-1600=4800 Hz (2000 Hz to 4800 Hz), assuming the bandwidth of the high band is 1600 Hz. In another example, for a median bit rate codec, the searching range can be from 2000 Hz to 6400-1600=4800 Hz (2000 Hz to 4800 Hz), assuming the bandwidth of the high band is 1600 Hz.

As the spectral envelope changes slowly from one frame to next frame, the best sub band starting point corresponding to the highest spectral formant energy is normally changed slowly. In order to avoid fluctuation or frequent change of the best sub band starting point from one frame to another frame, some smoothing may be applied during the same voiced region in time domain, unless the spectral peak energy is dramatically changed from one frame to next frame or a new voiced region comes.

Figure 10:
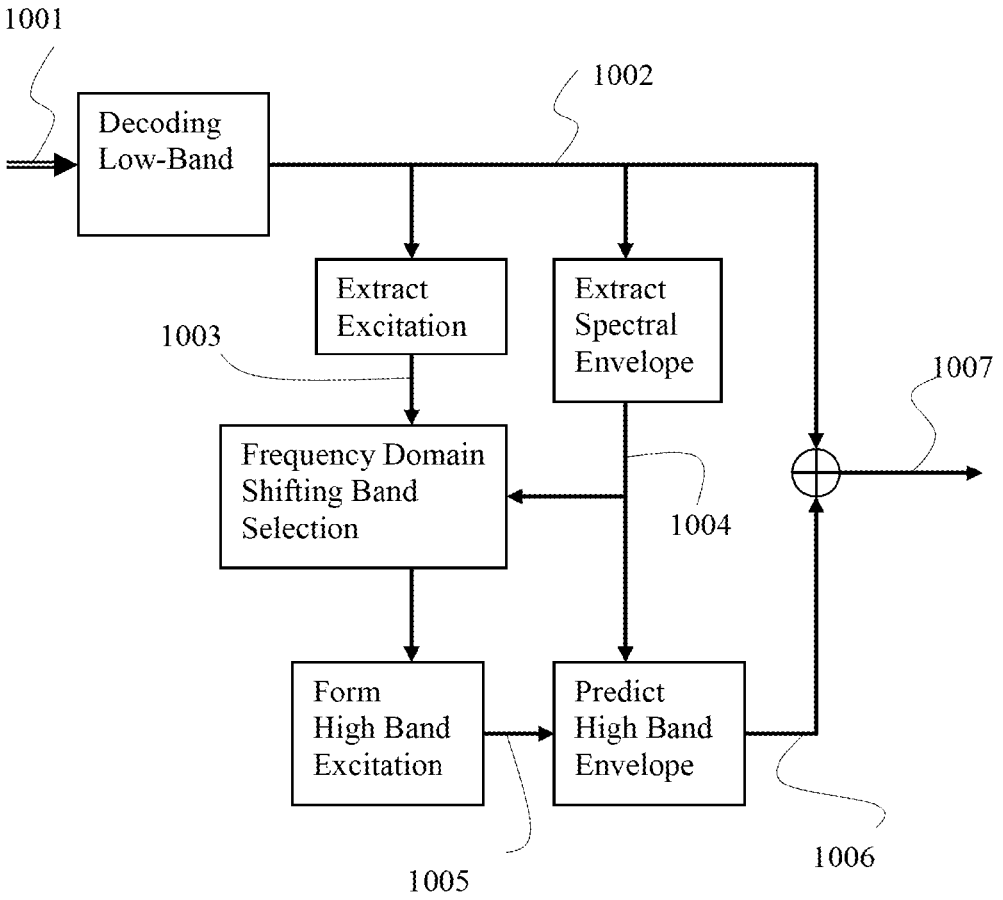
FIG. 10 illustrates operations at a decoder in accordance with embodiments of the present invention for implementing sub band shifting or copying for BWE.

FIG. 10 illustrates operations at a decoder in accordance with embodiments of the present invention for implementing sub band shifting or copying for BWE.

The time domain low band signal 1002 is decoded by using the received bitstream 1001. The low band time domain excitation 1003 is usually available at the decoder. Sometimes, the low band frequency domain excitation is also available. If not available, the low band time domain excitation 1003 can be transformed into frequency domain to get the low band frequency domain excitation.

The spectral envelope of the voiced speech or music signal is often represented by LPC parameters. Sometimes, the direct frequency domain spectral envelope is available at the decoder. In any case, the energy distribution information 1004 can be extracted from the LPC parameters or from the direct frequency domain spectral envelope or any parameters such as DFT domain or FFT domain. Using the low band energy distribution information 1004, the best sub band from the low band is selected by searching for the relatively high energy peak. The selected sub band is then copied from the low band to the high band area. A predicted or estimated high band spectral envelope is then applied to the high band area, or a time domain high band excitation 1005 goes through a predicted or estimated high band filter which represents the high band spectral envelope. The output of the high band filter is the high band signal 1006. The final speech/audio output signal 1007 is obtained by combing the low band signal 1002 and the high band signal 1006.

Figure 11:
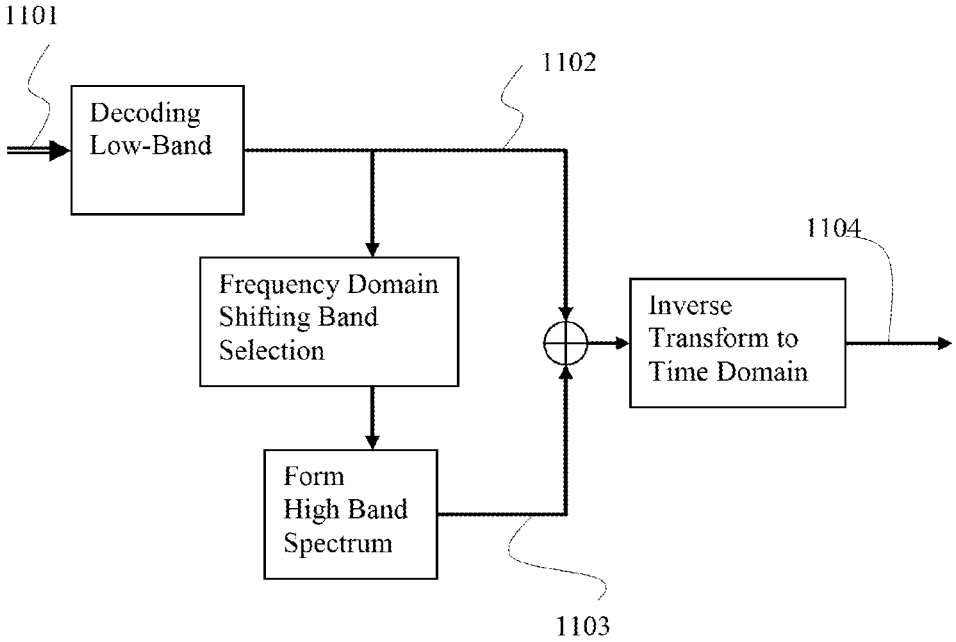
FIG. 11 illustrates an alternative embodiment of the decoder for implementing sub band shifting or copying for BWE.

FIG. 11 illustrates an alternative embodiment of the decoder for implementing sub band shifting or copying for BWE.

Unlike FIG. 10, FIG. 11 assumes that the frequency domain low band spectrum is available. The best sub band in the low frequency band is selected by simply searching for the relatively high energy peak in the frequency domain. Then, the selected sub band is copied from the low band to the high band. After applying an estimated high band spectral envelope, the high band spectrum 1103 is formed. The final frequency domain speech/audio spectrum is obtained by combing the low band spectrum 1102 and the high band spectrum 1103. The final time domain speech/audio signal output is produced by transforming the frequency domain speech/audio spectrum into the time domain.

When filter bank analysis and synthesis are available at the decoder covering the desired spectrum range, SBR algorithm can realize frequency band shifting by copying low frequency band coefficients of the output correspond to the selected low band from the filter bank analysis to high frequency band area.

Figure 12:
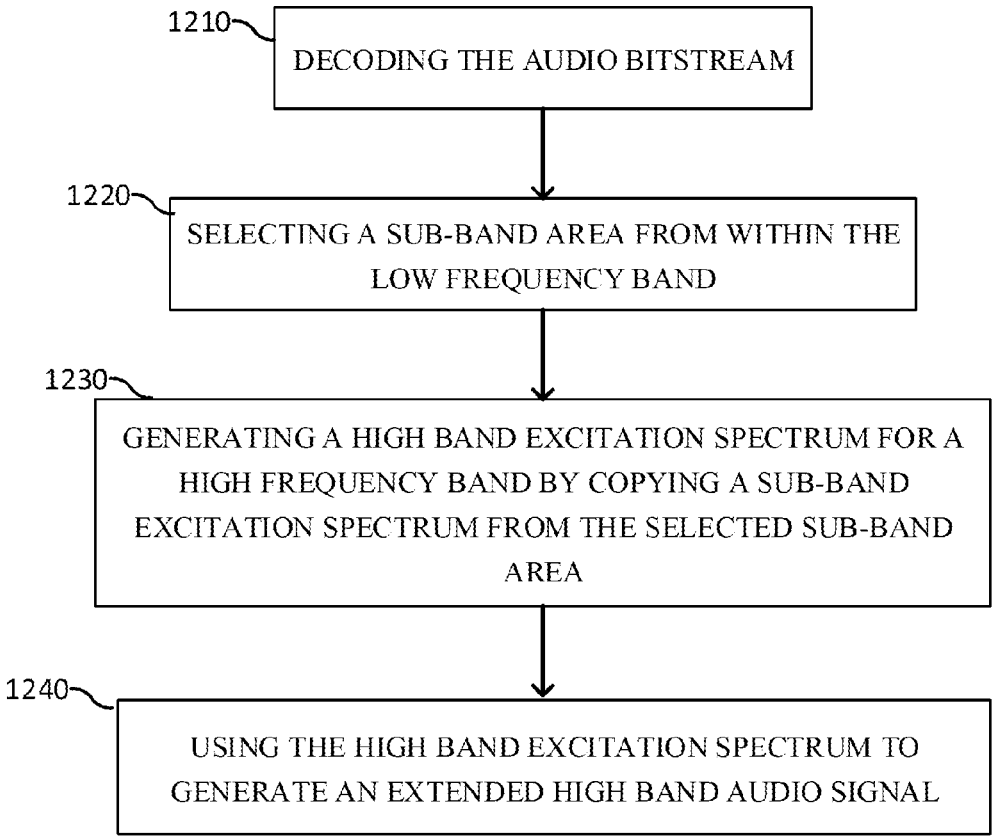
FIG. 12 illustrates operations performed at a decoder in accordance with embodiments of the present invention.

FIG. 12 illustrates operations performed at a decoder in accordance with embodiments of the present invention.

Referring to FIG. 12, a method of decoding an encoded audio bitstream at a decoder includes receiving a coded audio bitstream. In one or more embodiments, the received audio bitstream has been CELP coded. In particular, only the low frequency band is coded by CELP. CELP produces relatively higher spectrum quality in higher spectral energy area than lower spectral energy area. Accordingly, embodiments of the present invention include decoding the audio bitstream to generate a decoded low band audio signal and a low band excitation spectrum corresponding to a low frequency band (box 1210). A sub-band area is selected from within the low frequency band using energy information of a spectral envelope of the decoded low band audio signal (box 1220). A high band excitation spectrum is generated for a high frequency band by copying a sub-band excitation spectrum from the selected sub-band area to a high sub-band area corresponding to the high frequency band (box 1230). An audio output signal is generated using the high band excitation spectrum (box 1240). In particular, using the generated high band excitation spectrum an extended high band audio signal is generated by applying a high band spectral envelope. The extended high band audio signal is added to the decoded low band audio signal to generate the audio output signal having an extended frequency bandwidth.

As described previously using FIGS. 10 and 11, embodiments of the present invention may be applied differently depending on whether the frequency domain spectrum envelope is available. For example, if the frequency domain spectrum envelope is available, the sub band with the highest sub band energy may be selected. If on the other hand, if the frequency domain spectrum envelope is not available, the energy distribution of the spectral envelope may be identified from the linear predictive coding (LPC) parameters, Discrete Fourier Transform (DFT) domain, or Fast Fourier Transform (FFT) domain parameters. Similarly, spectral formant peak information if available (or computable) may be used in some embodiment. If only the low band time domain excitation is available, the low band frequency domain excitation may be computed by transforming the low band time domain excitation to frequency domain.

In various embodiments, the spectral envelope may be computed using any known method as would be known to a person having ordinary skill in the art. For example, in the frequency domain, the spectral envelope may be simply a set of energies which represent energies of a set of sub-bands. Similarly, in another example, in time domain, the spectral envelope may be represented by LPC parameters. LPC parameters may have many forms such as Reflection Coefficients, LPC Coefficients, LSP Coefficients, LSF Coefficients in various embodiments.

Figure 13A:
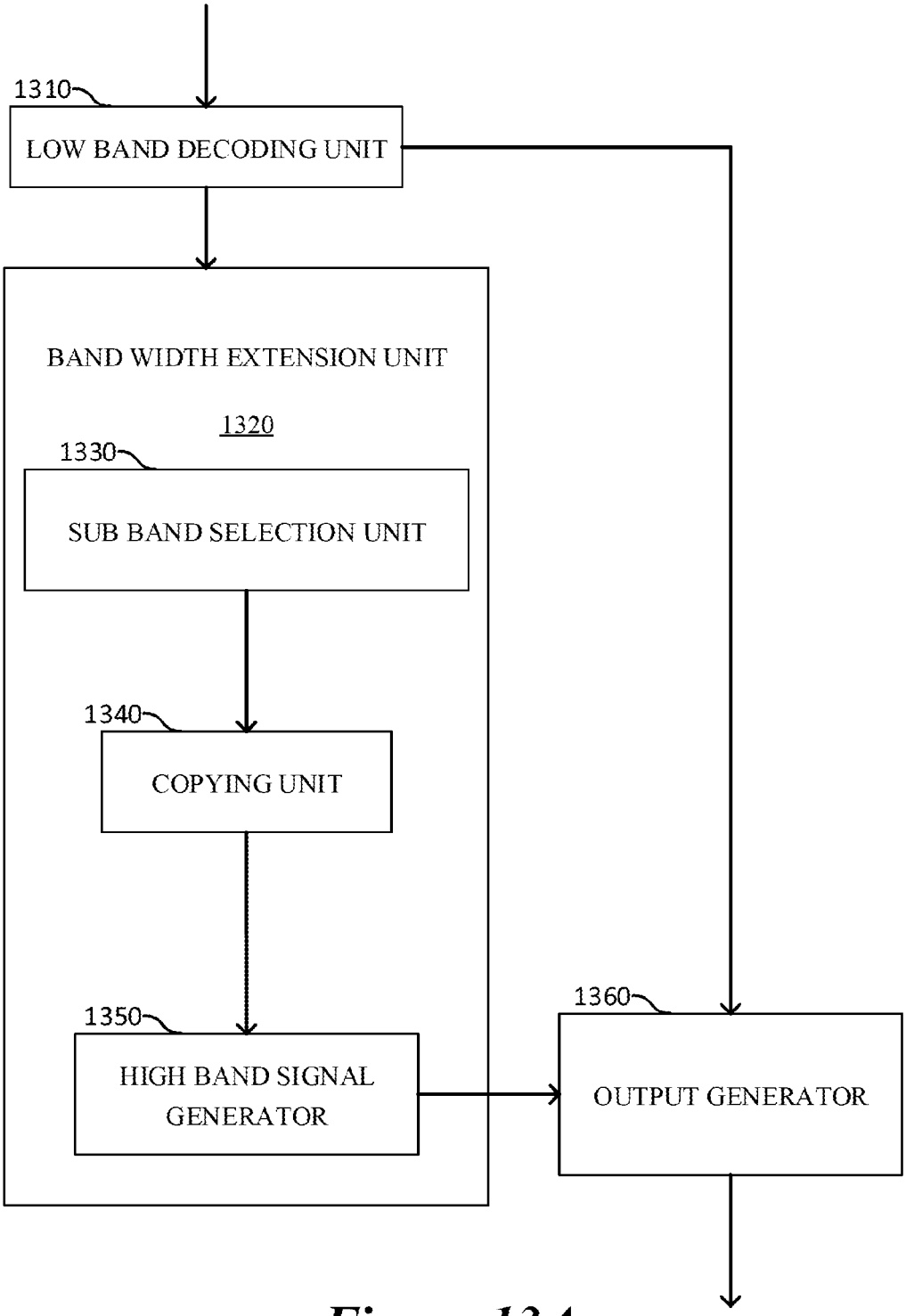
FIGS. 13A and 13B illustrate a decoder implementing band width extension in accordance with embodiments of the present invention.
Figure 13B:
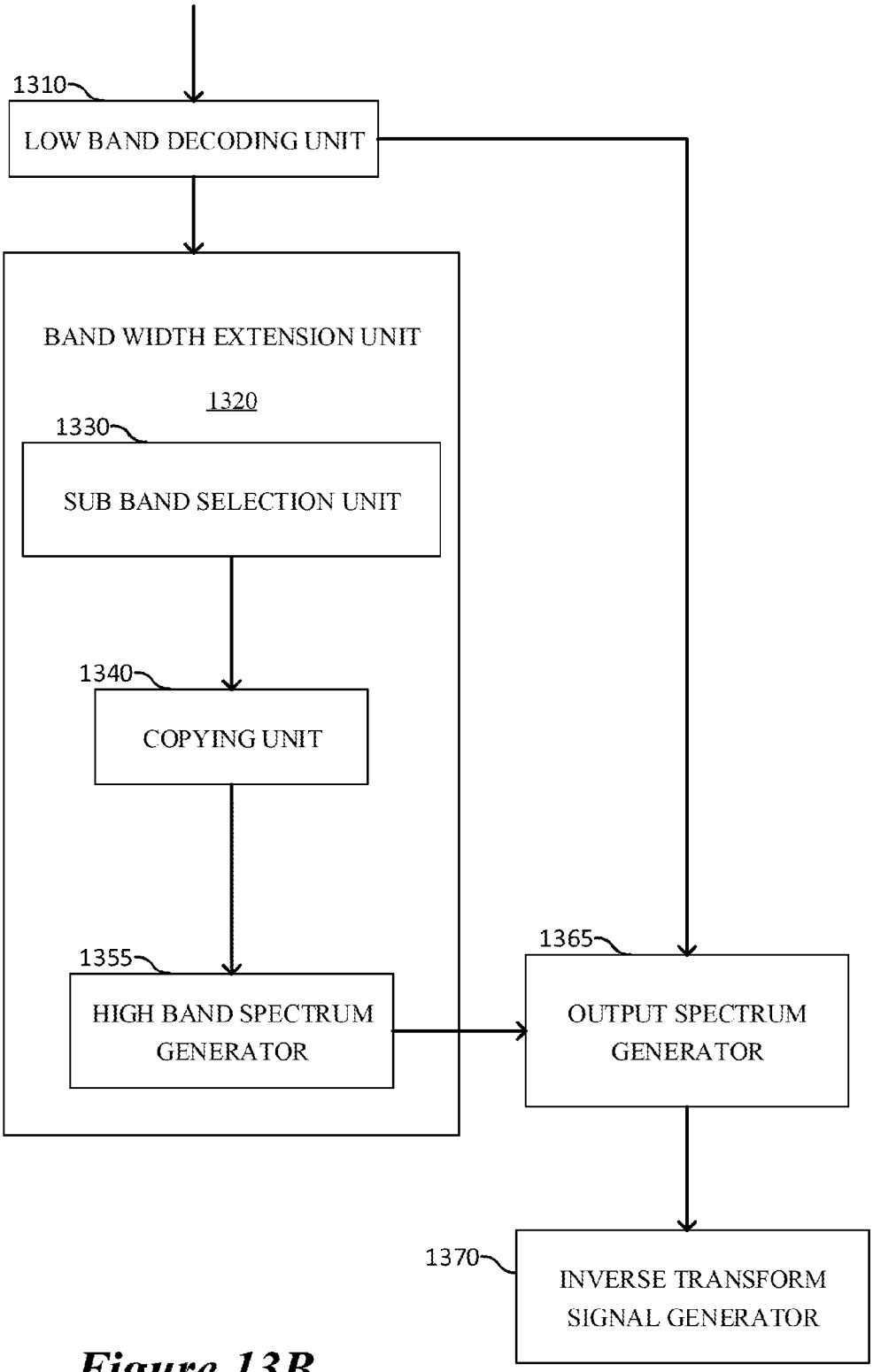

FIGS. 13A and 13B illustrate a decoder implementing band width extension in accordance with embodiments of the present invention.

Referring to FIG. 13A, a decoder for decoding an encoded audio bitstream comprises a low band decoding unit 1310 configured to decode the audio bitstream to generate a low band excitation spectrum corresponding to a low frequency band.

The decoder further includes a band width extension unit 1320 coupled to the low band decoding unit 1310 and comprising a sub band selection unit 1330 and a copying unit 1340. The sub band selection unit 1330 is configured to select a sub-band area from within the low frequency band using energy information of a spectral envelope of the decoded audio bitstream. The copying unit 1340 is configured to generate a high band excitation spectrum for a high frequency band by copying a sub-band excitation spectrum from the selected sub-band area to a high sub-band area corresponding to the high frequency band.

A high band signal generator 1350 is coupled to the copying unit 1340. The high band signal generator 1350 is configured to apply a predicted high band spectral envelope to generate a high band time domain signal. An output generator is coupled to the high band signal generator 1350 and the low band decoding unit 1310. The output generator 1360 is configured to generate an audio output signal by combining a low band time domain signal obtained by decoding the audio bitstream with the high band time domain signal.

FIG. 13B illustrates an alternative embodiment of a decoder implementing band width extension.

Similar to FIG. 13A, the decoder of FIG. 13B also includes a low band decoding unit 1310 and a band width extension unit 1320, which is coupled to the low band decoding unit 1310, and comprising a sub band selection unit 1330 and a copying unit 1340.

Referring to FIG. 13B, the decoder further includes a high band spectrum generator 1355, which is coupled to the copying unit 1340. The high band signal generator 1355 is configured to apply a high band spectral envelope energy to generate a high band spectrum for the high frequency band using the high band excitation spectrum.

An output spectrum generator 1365 is coupled to the high band spectrum generator 1355 and the low band decoding unit 1310. The output spectrum generator is configured to generate a frequency domain audio spectrum by combining a low band spectrum obtained by decoding the audio bitstream from the low band decoding unit 1310 with the high band spectrum from the high band spectrum generator 1355.

An inverse transform signal generator 1370 is configured to generate a time domain audio signal by inverse transforming the frequency domain audio spectrum into time domain.

The various components described in FIGS. 13A and 13B may be implemented in hardware in one or more embodiments. In some embodiments, they may be implemented in software and designed to operate in a signal processor.

Accordingly, embodiments of the present invention may be used to improve bandwidth extension at a decoder decoding a CELP coded audio bitsteam.

Figure 14:
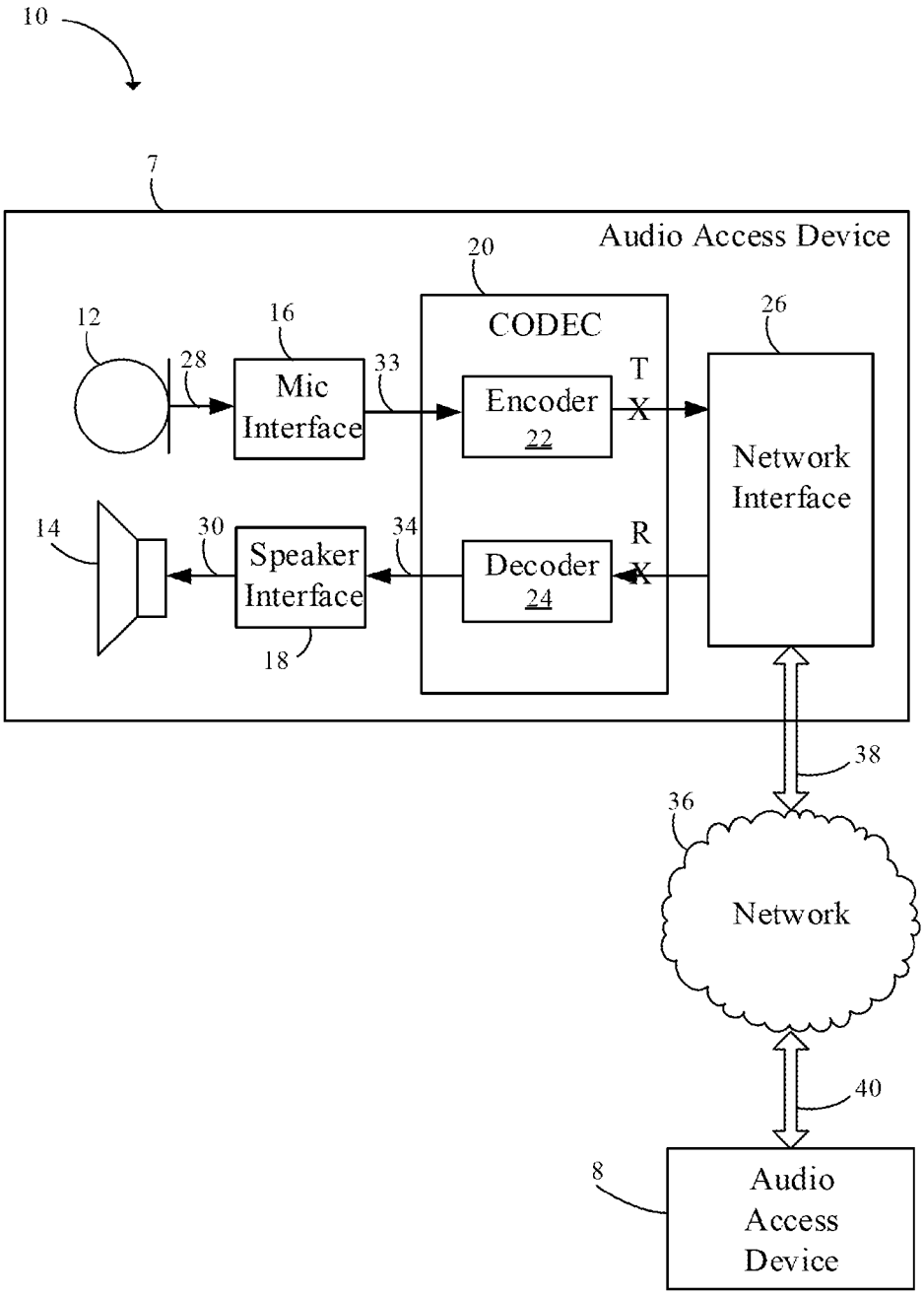
FIG. 14 illustrates a communication system according to an embodiment of the present invention.

FIG. 14 illustrates a communication system 10 according to an embodiment of the present invention.

Communication system 10 has audio access devices 7 and 8 coupled to a network 36 via communication links 38 and 40. In one embodiment, audio access device 7 and 8 are voice over internet protocol (VOIP) devices and network 36 is a wide area network (WAN), public switched telephone network (PTSN) and/or the internet. In another embodiment, communication links 38 and 40 are wireline and/or wireless broadband connections. In an alternative embodiment, audio access devices 7 and 8 are cellular or mobile telephones, links 38 and 40 are wireless mobile telephone channels and network 36 represents a mobile telephone network.

The audio access device 7 uses a microphone 12 to convert sound, such as music or a person's voice into an analog audio input signal 28. A microphone interface 16 converts the analog audio input signal 28 into a digital audio signal 33 for input into an encoder 22 of a CODEC 20. The encoder 22 produces encoded audio signal TX for transmission to a network 26 via a network interface 26 according to embodiments of the present invention. A decoder 24 within the CODEC 20 receives encoded audio signal RX from the network 36 via network interface 26, and converts encoded audio signal RX into a digital audio signal 34. The speaker interface 18 converts the digital audio signal 34 into the audio signal 30 suitable for driving the loudspeaker 14.

In embodiments of the present invention, where audio access device 7 is a VOIP device, some or all of the components within audio access device 7 are implemented within a handset. In some embodiments, however, microphone 12 and loudspeaker 14 are separate units, microphone interface 16, speaker interface 18, CODEC 20 and network interface 26 are implemented within a personal computer. CODEC 20 can be implemented in either software running on a computer or a dedicated processor, or by dedicated hardware, for example, on an application specific integrated circuit (ASIC). Microphone interface 16 is implemented by an analog-to-digital (A/D) converter, as well as other interface circuitry located within the handset and/or within the computer. Likewise, speaker interface 18 is implemented by a digital-to-analog converter and other interface circuitry located within the handset and/or within the computer. In further embodiments, audio access device 7 can be implemented and partitioned in other ways known in the art.

In embodiments of the present invention where audio access device 7 is a cellular or mobile telephone, the elements within audio access device 7 are implemented within a cellular handset. CODEC 20 is implemented by software running on a processor within the handset or by dedicated hardware. In further embodiments of the present invention, audio access device may be implemented in other devices such as peer-to-peer wireline and wireless digital communication systems, such as intercoms, and radio handsets. In applications such as consumer audio devices, audio access device may contain a CODEC with only encoder 22 or decoder 24, for example, in a digital microphone system or music playback device. In other embodiments of the present invention, CODEC 20 can be used without microphone 12 and speaker 14, for example, in cellular base stations that access the PTSN.

The speech processing for improving unvoiced/voiced classification described in various embodiments of the present invention may be implemented in the encoder 22 or the decoder 24, for example. The speech processing for improving unvoiced/voiced classification may be implemented in hardware or software in various embodiments. For example, the encoder 22 or the decoder 24 may be part of a digital signal processing (DSP) chip.

Figure 15:
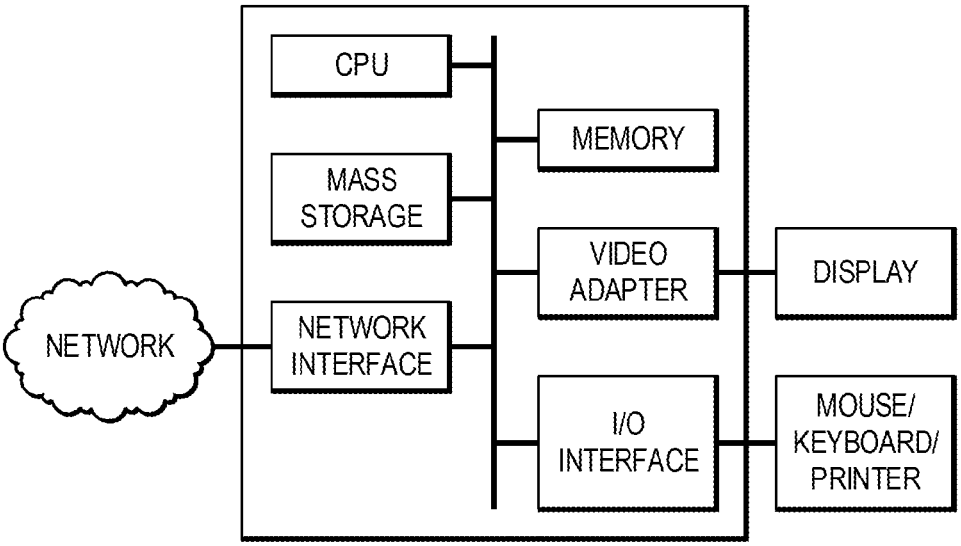
FIG. 15 illustrates a block diagram of a processing system that may be used for implementing the devices and methods disclosed herein.

FIG. 15 illustrates a block diagram of a processing system that may be used for implementing the devices and methods disclosed herein. Specific devices may utilize all of the components shown, or only a subset of the components, and levels of integration may vary from device to device. Furthermore, a device may contain multiple instances of a component, such as multiple processing units, processors, memories, transmitters, receivers, etc. The processing system may comprise a processing unit equipped with one or more input/output devices, such as a speaker, microphone, mouse, touchscreen, keypad, keyboard, printer, display, and the like. The processing unit may include a central processing unit (CPU), memory, a mass storage device, a video adapter, and an I/O interface connected to a bus.

The bus may be one or more of any type of several bus architectures including a memory bus or memory controller, a peripheral bus, video bus, or the like. The CPU may comprise any type of electronic data processor. The memory may comprise any type of system memory such as static random access memory (SRAM), dynamic random access memory (DRAM), synchronous DRAM (SDRAM), read-only memory (ROM), a combination thereof, or the like. In an embodiment, the memory may include ROM for use at boot-up, and DRAM for program and data storage for use while executing programs.

The mass storage device may comprise any type of storage device configured to store data, programs, and other information and to make the data, programs, and other information accessible via the bus. The mass storage device may comprise, for example, one or more of a solid state drive, hard disk drive, a magnetic disk drive, an optical disk drive, or the like.

The video adapter and the I/O interface provide interfaces to couple external input and output devices to the processing unit. As illustrated, examples of input and output devices include the display coupled to the video adapter and the mouse/keyboard/printer coupled to the I/O interface. Other devices may be coupled to the processing unit, and additional or fewer interface cards may be utilized. For example, a serial interface such as Universal Serial Bus (USB) (not shown) may be used to provide an interface for a printer.

The processing unit also includes one or more network interfaces, which may comprise wired links, such as an Ethernet cable or the like, and/or wireless links to access nodes or different networks. The network interface allows the processing unit to communicate with remote units via the networks. For example, the network interface may provide wireless communication via one or more transmitters/transmit antennas and one or more receivers/receive antennas. In an embodiment, the processing unit is coupled to a local-area network or a wide-area network for data processing and communications with remote devices, such as other processing units, the Internet, remote storage facilities, or the like.

While this invention has been described with reference to illustrative embodiments, this description is not intended to be construed in a limiting sense. Various modifications and combinations of the illustrative embodiments, as well as other embodiments of the invention, will be apparent to persons skilled in the art upon reference to the description. For example, various embodiments described above may be combined with each other.

Although the present invention and its advantages have been described in detail, it should be understood that various changes, substitutions and alterations can be made herein without departing from the spirit and scope of the invention as defined by the appended claims. For example, many of the features and functions discussed above can be implemented in software, hardware, or firmware, or a combination thereof. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed, that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A method of decoding an encoded audio bitstream and generating frequency bandwidth extension at a CODEC, the method comprising:

decoding the audio bitstream to generate a decoded low band audio signal and generate a low band excitation spectrum corresponding to a low frequency band;

selecting a sub-band area from within the low frequency band using a parameter which indicates energy information of a spectral envelope of the decoded low band audio signal wherein the selected sub-band area is within a region corresponding to an energy peak of the spectral envelope;

generating a high band excitation spectrum for a high frequency band by copying a sub-band excitation spectrum from the selected sub-band area to a high sub-band area corresponding to the high frequency band;

generating an extended high band audio signal according to a high band spectral envelope and the generated high band excitation spectrum; and adding the extended high band audio signal to the decoded low band audio signal to generate an audio output signal having an extended frequency bandwidth.

2. The method of claim 1, wherein selecting a sub-band area from within the low frequency band using the parameter comprises identifying the highest quality sub-band within the low frequency band by searching an highest energy point of the spectral envelope and selecting the identified highest quality sub-band.

3. The method of claim 1, wherein selecting a sub-band area from within the low frequency band using the parameter comprises selecting the sub-band area corresponding to highest spectral envelope energy.

4. The method of claim 1, wherein selecting a sub-band area from within the low frequency band using the parameter comprises identifying a sub-band from within the low band by using parameters reflecting an highest energy of the spectral energy envelope or spectral formant peak and selecting the identified sub-band.

5. The method of claim 1, wherein the method of decoding applies a bandwidth extension technology to generate the high frequency band.

6. The method of claim 1, wherein applying the high band spectral envelope comprises applying a predicted high band filter representing the high band spectral envelope.

7. The method of claim 1, further comprising:

generating the audio output signal by inverse transforming the frequency domain audio spectrum into time domain.

8. The method of claim 1, wherein copying the sub-band excitation spectrum from the selected sub-band area to the high sub-band area corresponding to the high frequency band comprises copying low frequency band coefficients of an output from a filter bank analysis to the high sub-band area.

9. The method of claim 1, wherein the audio bitstream comprises voiced speech or harmonic music.

10. A decoding device for speech processing comprising:

a processor; and a computer readable storage medium coupled to the processor; wherein the computer readable storage medium is configured to store an executable program, wherein the processor is configured to run the executable program so as to:

decode the audio bitstream to generate a decoded low band audio signal and generate a low band excitation spectrum corresponding to a low frequency band;

select a sub-band area from within the low frequency band using a parameter which indicates energy information of a spectral envelope of the decoded low band audio signal, wherein the selected sub-band area is within a region corresponding to an energy peak of the spectral envelope;

generate a high band excitation spectrum for a high frequency band by copying a sub-band excitation spectrum from the selected sub-band area to a high sub-band area corresponding to the high frequency band;

generate an extended high band audio signal according to a high band spectral envelope and the generated high band excitation spectrum; and add the extended high band audio signal to the decoded low band audio signal to generate an audio output signal having an extended frequency bandwidth.

11. The decoding device according to claim 10, wherein the processor is configured to run the executable program so as to:

identify the highest quality sub-band within the low frequency band by searching an highest energy point of the spectral envelope; and select the identified highest quality sub-band.

12. The decoding device according to claim 10, wherein the processor is configured to run the executable program so as to:

select the sub-band area corresponding to highest spectral envelope energy.

13. The decoding device according to claim 10, wherein the processor is configured to run the executable program so as to:

identify a sub-band from within the low band by using parameters reflecting an highest energy of the spectral energy envelope or spectral formant peak and select the identified sub-band.

14. The decoding device according to claim 10, wherein the processor is configured to run the executable program so as to:

apply a predicted high band filter representing the high band spectral envelope to generate a high band time domain signal; and generate an audio output signal by combining a low band time domain signal obtained by decoding the audio bitstream with the high band time domain signal.

15. The decoding device according to claim 10, wherein the processor is configured to run the executable program so as to:

copy low frequency band coefficients of an output from a filter bank analysis to the high sub-band area.

16. The decoding device according to claim 10, wherein the processor is configured to run the executable program so as to:

apply an estimated high band spectral envelope to generate a high band spectrum for the high frequency band using the high band excitation spectrum; and generate a frequency domain audio spectrum by combining a low band spectrum obtained by decoding the audio bitstream with the high band spectrum.

17. The decoding device according to claim 10, wherein the processor is configured to run the executable program so as to:

generate a time domain audio signal by inverse transforming the frequency domain audio spectrum into time domain.

18. A method of decoding an encoded audio bitstream and generating frequency bandwidth extension at a CODEC, the method comprising:

decoding the audio bitstream to generate a decoded low band audio signal and generate a low band spectrum corresponding to a low frequency band;

selecting a sub-band area from within the low frequency band using a parameter which indicates energy information of a spectral envelope of the decoded low band audio signal; wherein the selected sub-band area is within a region corresponding to an energy peak of the spectral envelope;

generating a high band spectrum by copying a sub-band spectrum from the selected sub-band area to a high sub-band area;

using the generated high band spectrum to generate an extended high band audio signal by applying a high band spectral envelope; and adding the extended high band audio signal to the decoded low band audio signal to generate an audio output signal having an extended frequency bandwidth.

19. The method of claim 18, wherein selecting a sub-band area from within the low frequency band using the parameter comprises selecting the sub-band area corresponding to highest spectral envelope energy.

20. The method of claim 18, wherein applying the high band spectral envelope comprises applying a predicted high band filter representing the high band spectral envelope.

* * * * *